US007981009B2

(12) United States Patent
Brenner et al.

(10) Patent No.: US 7,981,009 B2
(45) Date of Patent: Jul. 19, 2011

(54) COLLAPSIBLE TRAINING STAND

(75) Inventors: Patricia Brenner, Encino, CA (US); Greg Snyder, San Rafael, CA (US)

(73) Assignee: Hico Inc., Encino, CA (US)

( * ) Notice: Subject to any disclaimer, the term of this patent is extended or adjusted under 35 U.S.C. 154(b) by 88 days.

(21) Appl. No.: 12/235,262

(22) Filed: Sep. 22, 2008

(65) Prior Publication Data

US 2009/0088302 A1 Apr. 2, 2009

Related U.S. Application Data

(60) Provisional application No. 60/975,984, filed on Sep. 28, 2007.

(51) Int. Cl.
*A63B 21/00* (2006.01)

(52) U.S. Cl. ..... 482/83; 482/87; 482/90

(58) Field of Classification Search ..... 482/83–90
See application file for complete search history.

(56) References Cited

U.S. PATENT DOCUMENTS

| | | | | |
|---|---|---|---|---|
| 4,434,980 | A | 3/1984 | Babineaux | |
| 5,460,343 | A * | 10/1995 | Hestilow | 248/124.1 |
| 5,722,920 | A * | 3/1998 | Bauer | 482/83 |
| 5,899,835 | A * | 5/1999 | Puranda | 482/90 |
| 5,984,842 | A | 11/1999 | Chu | |
| 6,110,079 | A | 8/2000 | Luedke et al. | |
| D437,908 | S | 2/2001 | Hsiung | |
| 2005/0181914 | A1 * | 8/2005 | Radkowski et al. | 482/83 |
| 2005/0250624 | A1 * | 11/2005 | Yu | 482/69 |
| 2007/0197348 | A1 * | 8/2007 | Ku | 482/83 |
| 2009/0098985 | A1 * | 4/2009 | Gonzalez | 482/83 |

* cited by examiner

*Primary Examiner* — Jerome W Donnelly

(74) *Attorney, Agent, or Firm* — Julio M. Loza; Loza & Loza, LLP

(57) ABSTRACT

A training device, including a collapsible stand having a central support shaft and a plurality of legs. In a first position, the legs and central support member shaft collapse into each other. In a second position, the legs and central support shaft extend perpendicular relative to each other into a self-supporting stand having the central support shaft in a substantially vertical position. A plurality of striking pads is releasably coupled to the central support shaft by a quick release connector. A T-bar support attaches to the central support shaft. The plurality of striking pads approximate the positioning of the hands of a person in an offensive/defensive position, the head of the person and the torso of the person.

12 Claims, 15 Drawing Sheets

COLLAPSIBLE TRAINING STAND

PRIORITY CLAIM

This application claims the benefit of U.S. Provisional Application Ser. No. 60/975,984 filed Sep. 28, 2007.

FIELD

Various features pertain to stands used for self-defense training, in particular to portable devices for practicing punching and kicking offensive and defensive techniques by hitting various pads or targets.

BACKGROUND

In the realm of exercise equipment, punching and/or kicking bags and targets are commonplace. Existing stands are designed to withstand punching and kicks and as a result tend to be bulky and/or permanent fixtures. As such, existing stands are not easy to move to different locations and are not easy to store away when not in use.

Additionally, users tend to be of different heights and have different exercise needs (e.g., punching versus kicking exercises, martial arts versus boxing, etc.). However, many existing punching and kicking exercise equipment are not easily adjustable to accommodate these needs.

One type of prior art portable exercise device for training self defense includes a large hollow base that is filled with water or sand to make it stable when kicking or punching the pads or targets. Such devices are typically very heavy after filled with water and sand and as a result they are difficult to store or move from one location to another.

Another type of prior art portable exercise device for training self-defense includes a human torso and head shape for practicing punching or kicking techniques. Such devices are not adjustable in the height or position of the head and torso, and as a result may not be appropriately sized for very tall or short people, or practicing techniques for a variety of human sizes.

Consequently, a portable stand for training self defense is needed that is stable, easily stored, moved around and easily adjustable over a range of heights and positions.

SUMMARY OF THE INVENTION

In one embodiment, a system for supporting one or more objects above an operating surface, the system including, (a) a central frame member having opposite first and second end portions, (b) a base operatively coupled with the first end portion of said central frame member; said base being selectively movable between collapsed and extended positions with respect to said frame, (c) at least one attachment member operatively coupled with the central frame member; and (d) at least one object operatively coupled with the attachment member for supporting the one or more objects above the operating surface is herein provided. The at least one attachment member may include a spring that enables said at least one attachment member to provide a resiliently deformable engagement between the one or more objects and the central frame member.

In another embodiment, a training device, including, (a) a collapsible stand having a central support shaft and a plurality of legs, wherein in a first position, the legs and central support member shaft collapse into each other and in a second position, the legs and central support shaft extend perpendicular relative to each other into a self-supporting stand having the central support shaft in a substantially vertical position, (b) and a plurality of striking pads releasably coupled to the central support shaft, each striking pad having a connecting arm including a resilient spring, each striking pad releasably coupled by a quick release connector is herein provided. The central support shaft may include one or more telescoping shafts.

The training device may further include at least one angled extension attachment coupling at least one of the plurality of striking pads. The at least one angled extension attachment may be angled, for example, between 90 and 135 degrees. The at least one angled extension attachment may include a resilient spring.

The training device may further include a T-bar support releasably coupled to the central support shaft, wherein the T-bar support is adapted to releasably couple additional striking pads. In one embodiment, at least one of the striking pads may be coupled to the T-bar support by the angled extension attachment and is positioned to approximate a hand of a person in a defensive or offensive position. In another embodiment, a striking pad is coupled to the central support shaft by the angled extension attachment and is positioned to approximate a head of a person. In yet another embodiment, a striking pad is coupled to the central support shaft and is positioned to approximate a torso of a person. Generally, the quick release connector allows for rotation of the striking pad about the training device.

In yet another embodiment, a training stand including, (a) a central support shaft, (b) at least two legs connected to the central shaft, the at least two legs adapted to collapse into the central support shaft in a first position and adapted to extend perpendicular to the central support shaft in a second position, (c) means for pivotally coupling the at least two legs to the central support shaft, and (d) means for releasably coupling at least one striking pad to the central support shaft is herein provided. The central support shaft may include one or more telescoping shafts.

The training device may further include means for angling at least one of the plurality of striking pads to the training stand between 90 degrees and 135 degrees. The training device may further include means for providing resilience to the means for angling at least one of the plurality of striking pads.

The training device may include a T-bar support releasably coupled to the central support shaft, wherein the T-bar support is adapted to releasably couple additional striking pads. At least one of the striking pads may be coupled to the T-bar support by the means for angling and is positioned to approximate a hand of a person in a defensive or offensive position. A striking pad may be coupled to the central support shaft by the means for angling and is positioned to approximate a head of a person and a striking pad may be coupled to the central support shaft and is positioned to approximate a torso of a person. The means for releasably coupling may provide for rotation of the striking pad about the training device.

DETAILED DESCRIPTION OF THE INVENTION

In the following detailed description of the invention, numerous specific details are set forth in order to provide a thorough understanding of the invention. However, the invention may be practiced without these specific details. In other instances well known methods, procedures, and/or components have not been described in detail so as not to unnecessarily obscure aspects of the invention.

One aspect of the present invention provides a training device for hitting and kicking exercises, where the device comprises a training stand and a plurality of horizontally adjustable and vertically adjustable targets (e.g., punching/kicking targets).

The training stand may be collapsible for storage. For example, the collapsible training stand may comprise square tubing that is connected with a variety of linkages that allow the training stand to be locked rigidly with a vertical square tube held securely in place. The training stand can easily be unlocked and folded down to a compact set of tubes that are easy to store.

Conventional training stands are either bolted to a wall or floor for permanent installation or have bulky hollow bases that must be filled with water or sand to keep them from moving. As a result they are not easily moved or stored. By contrast, the portable training stand according to embodiments of the invention may be set up quickly and may quickly collapse for easy moving or storage.

Figure 14:
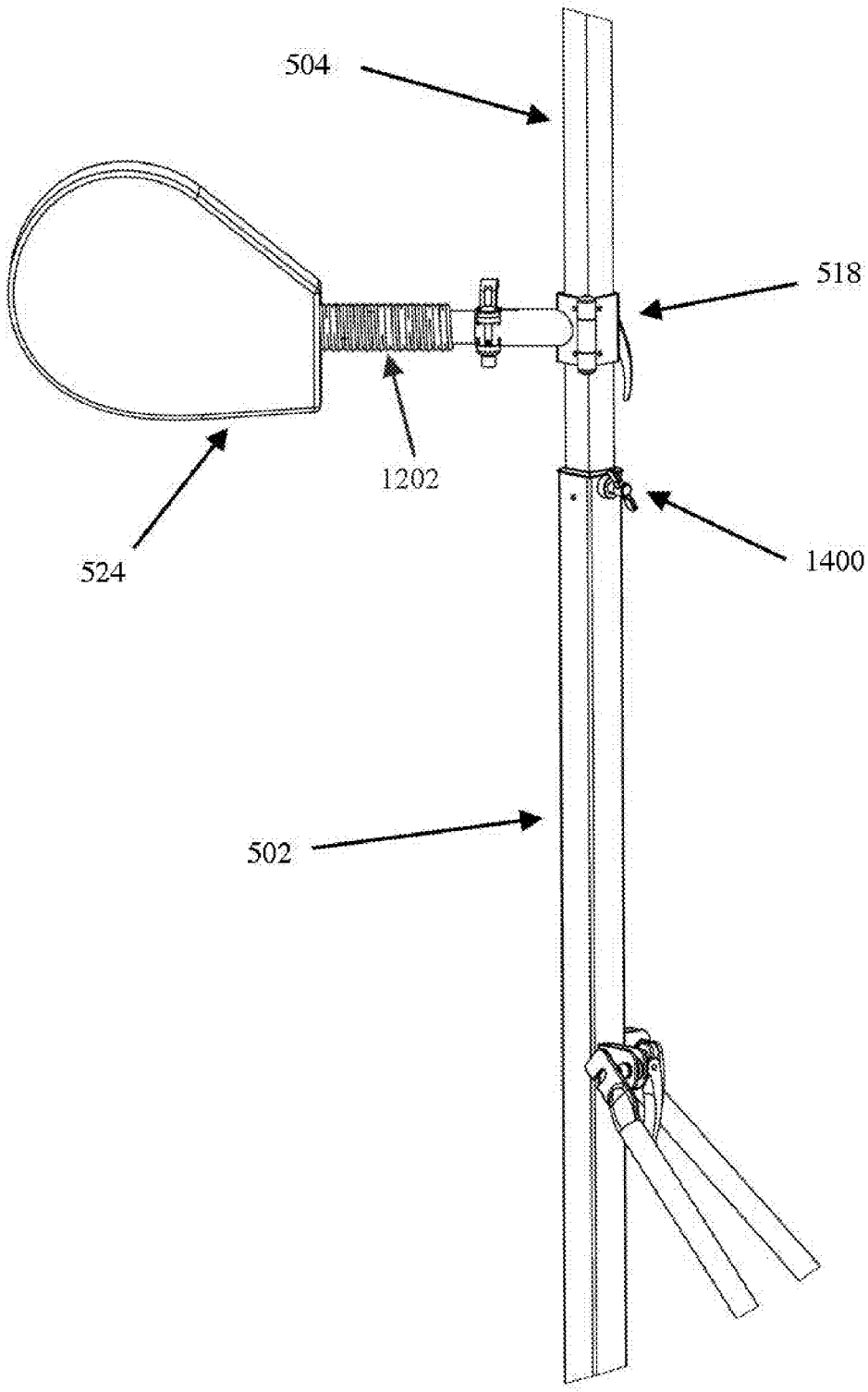
FIG. 14 illustrates a close-up view of at least one target positioned on the training stand of FIG. 9.

FIGS. 1 through 6 illustrate the training stand 100 in its upright and usable configuration from different perspectives. The training stand 100 includes a central frame member, i.e., a central support shaft 502 having one or more telescoping pieces 504 that can allow for adjusting the height of the stand. That is, the one or more telescoping pieces 504 can be extended or retracted to a desired height for exercising or mounting striking/kicking pads or targets. A locking mechanism 1400 (shown in FIG. 14), such as a pin, screw, or clamp, may serve to lock the one or more telescoping pieces 504 at a particular height. The training stand 100 may be adjustable in height by having a locking clamp 1400 that allows the telescoping pieces 504 to extend or retract from the central support shaft 502.

Additionally, a base operatively coupled to the central support shaft 502 includes folding legs 506 and 508 which may be pivotally coupled to one end of the central support shaft 502. Side linkages 512 and 514 serve to couple the central support shaft 502 and legs 506 and 508 in a fixed position. In the preferred configuration, a first end of the linkages 512 and 514 may be pivotally coupled to the legs 506 and 508 and a second end of the linkages hook onto brackets and clamp into place using a quick release clamp 516. When the side linkages 512 and 514 are locked into place on the central support shaft 502, the legs 506 and 508 are maintained substantially perpendicular to the central support shaft 502. When the side linkages 512 and 514 are unclamped from the central support shaft 502, they may be pivotally rotated around their connections with the folding legs 506 and 508 to collapse the training stand for storage. Alternatively, the side linkages 512 and 514 may be locked into place on the central support shaft 502 using pins, screws or any equivalent thereof.

In another example, the second end of the linkages 512 and 514 may be pivotally attached to a collar that slides on the central support shaft 502. The sliding collar may be locked into position on the central support shaft 502 to maintain the legs 506 and 508 substantially perpendicular to the central support shaft 502. The sliding collar may use a pin, a clamp, a screw or an equivalent mechanism to lock it into position.

Figure 8:
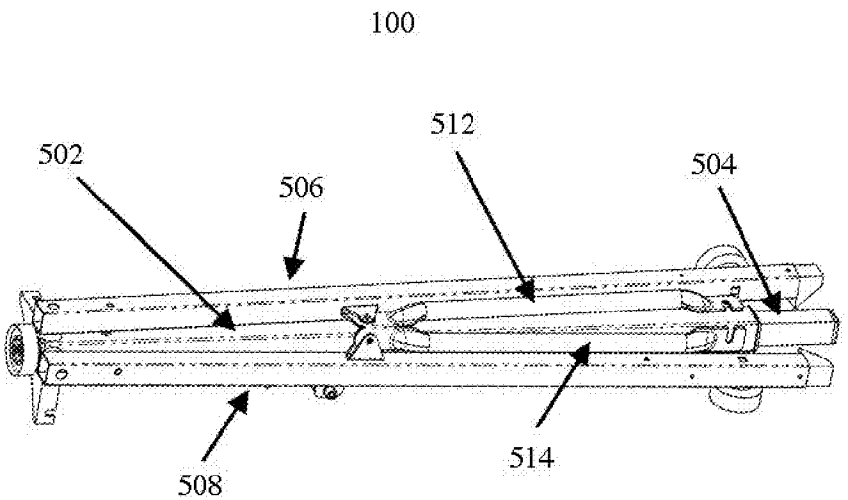
FIG. 8 illustrates a perspective view of the training stand of FIG. 1 in a collapsed state with no attachments thereon.
Figure 7:
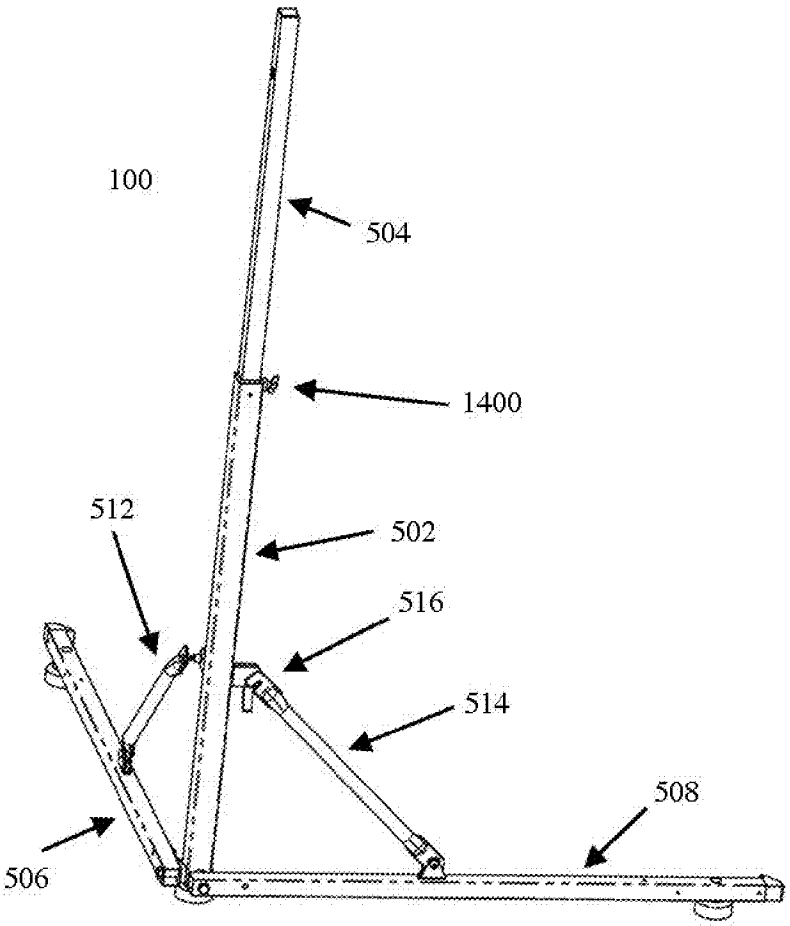
FIG. 7 illustrates a perspective view of the training stand of FIG. 1 in an expanded state with no attachments thereon.

FIG. 7 shows the training stand 100 in an upright and fully extended position with all the training pads, targets and other attachments removed. FIG. 8 shows the training stand 100 in its collapsed configuration for storage. As illustrated, the legs 506 and 508 may be folded against the central support shaft 502 while the telescoping pieces 504 may be retracted into the central support shaft 502.

The stand 100 may have square tubing or it might have some other tubing shape such as round or rectangular, for example. Additionally, the length of the folding legs 506 and 508 of the support stand 100 may be selected to provide stability to the stand 100 when it is used for punching or kicking training.

Figure 5:
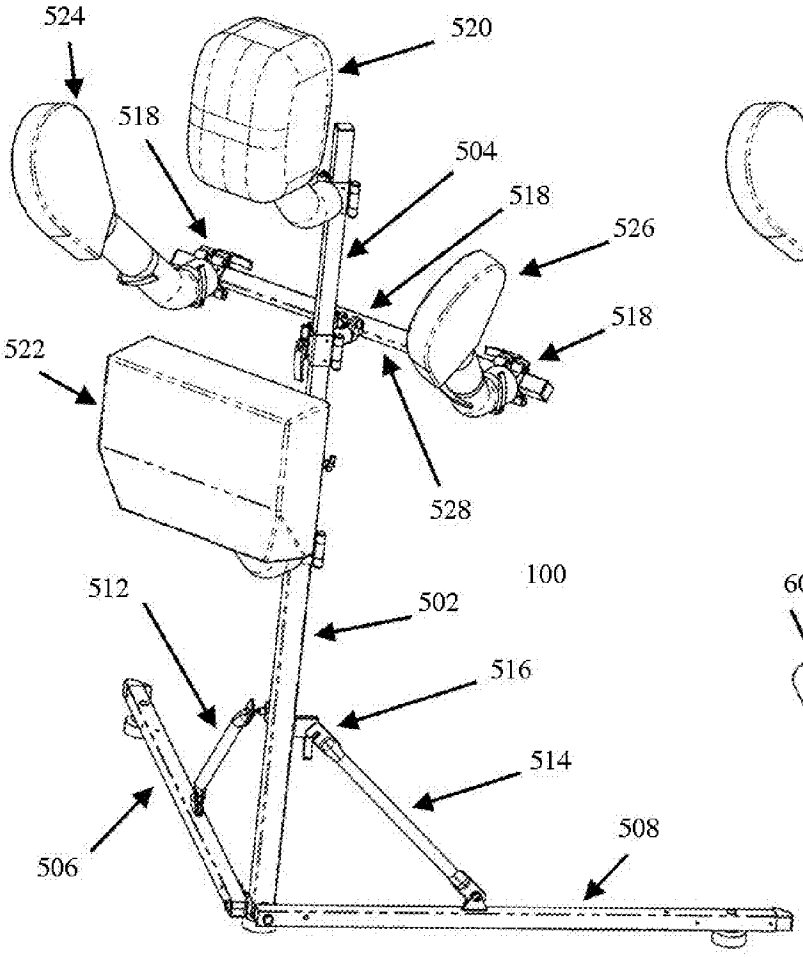
FIG. 5 illustrates a perspective view of the training stand of FIG. 1.
Figure 15:
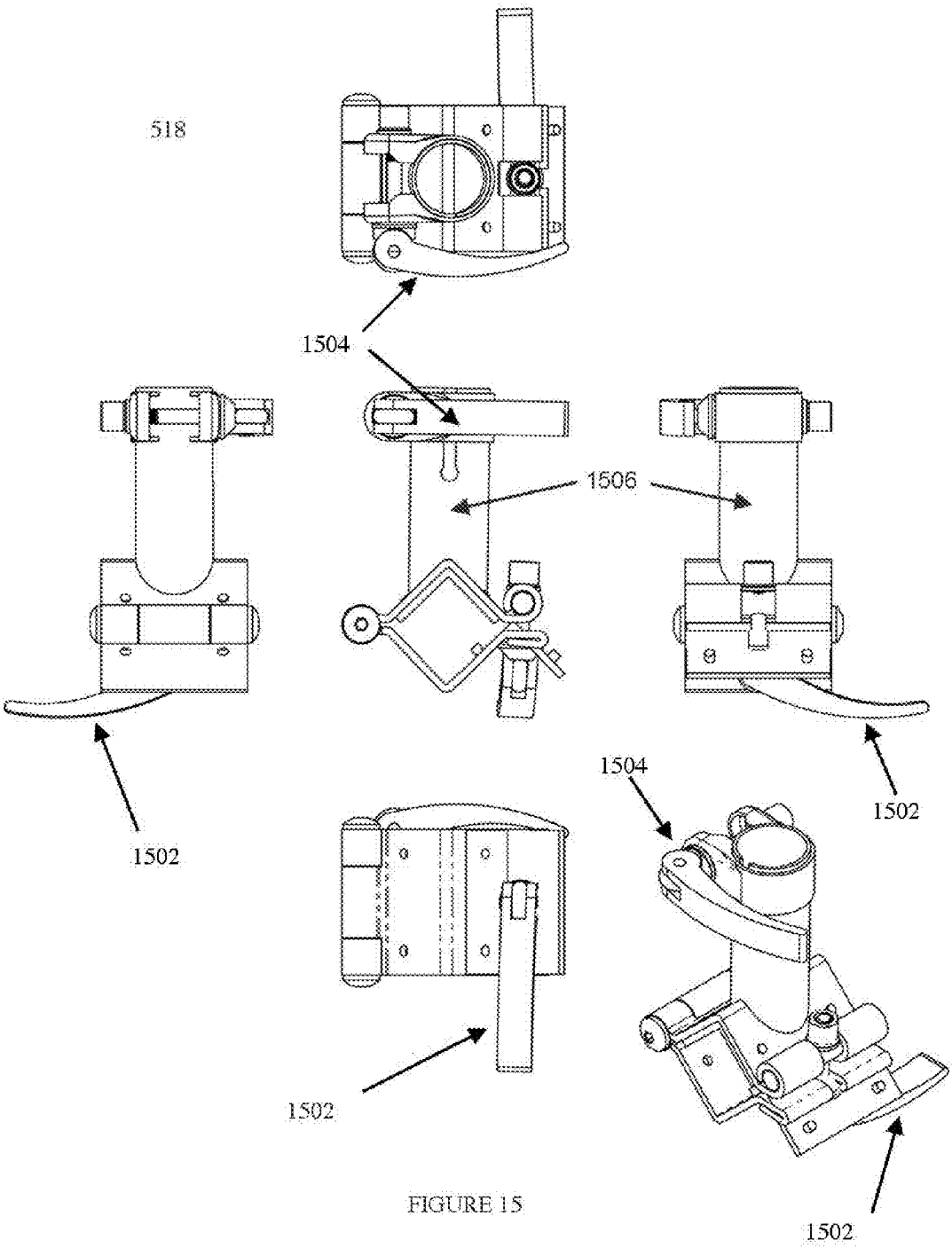
FIG. 15 illustrates various views of an embodiment of a connector which may be used in conjunction with the training stand of FIG. 1 and FIG. 9.

One advantage of this training device is that each pad, target and connector is easily removed from the stand 100 for storage through the use of quick release connectors or other easy to actuate clamping or pin mechanisms. The training stand 100 may include a plurality of connectors for attaching different training pads and targets. FIG. 5 shows a connector 518 (i.e., attachment member) on several locations on the training stand 100, i.e., on three (3) different locations on a T-Bar support 528. An example of a connector 518 that may be used is shown in FIG. 15. In one embodiment, T-Bar support 528 may be rotatable three hundred and sixty (360) degrees about the tube 1506 in the connector 518.

Figure 16:
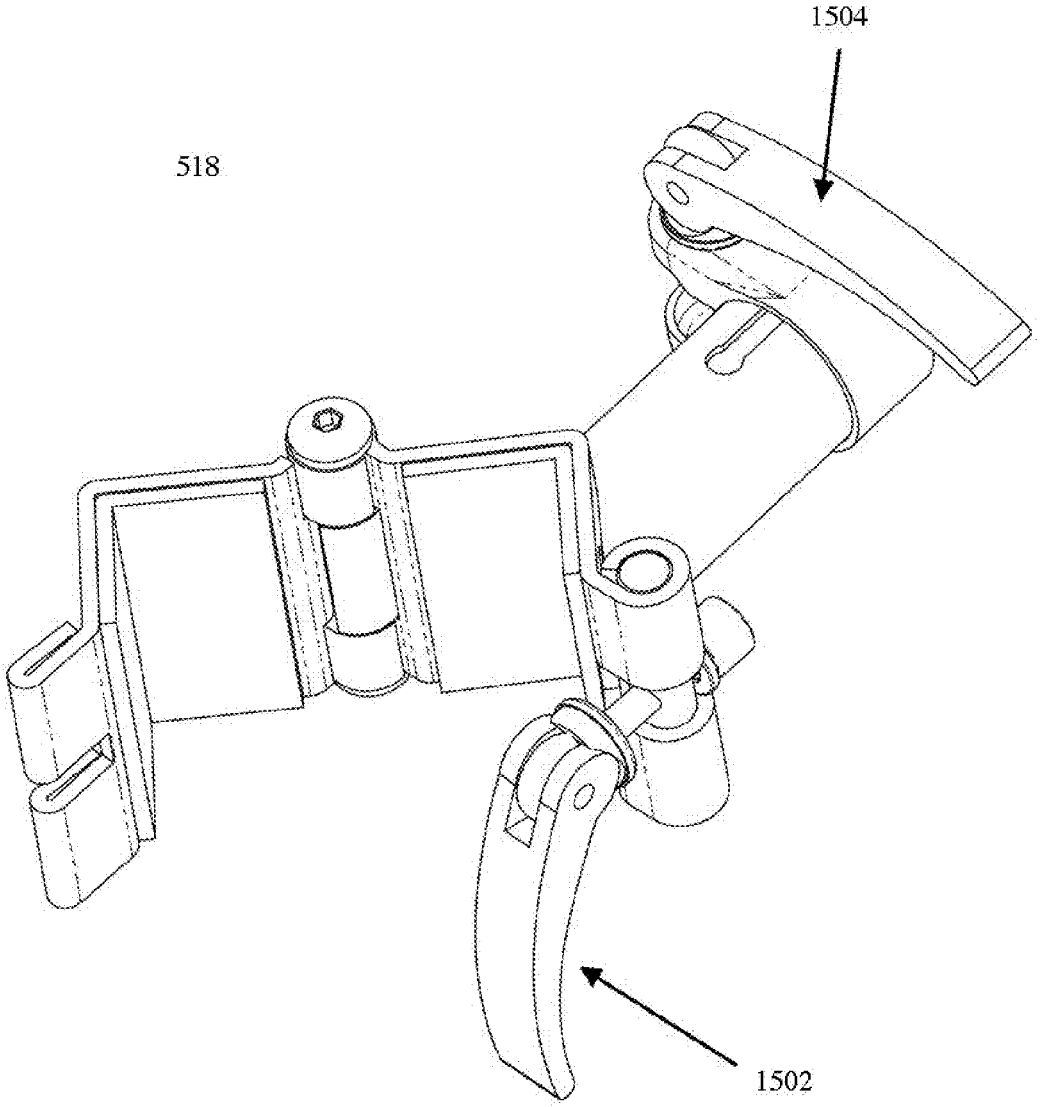
FIG. 16 illustrates a close-up view of the connector of FIG. 15.

FIG. 15 shows several views of the connector 518 in its closed configuration. FIG. 16 shows the connector 518 in its open configuration. Each of the connectors 518 may be attached anywhere along the length of the central support shaft 502 and telescoping piece 504 and locked rigidly thereto. Additionally, each of the connectors 518 may be attached anywhere along the length of the T-Bar support 528. The use of quick release clamps 1502 to attach the connectors 518 to the stand allow for easy attachment, easy removal and easy adjustability along the central support shaft 502 and the telescoping piece 504. The use of quick release clamps 1504 also allow for easy attachment, easy removal and easy adjustability of different training pads and targets without removing the connector from the central support shaft 502 or the telescoping piece 504.

Figure 6:
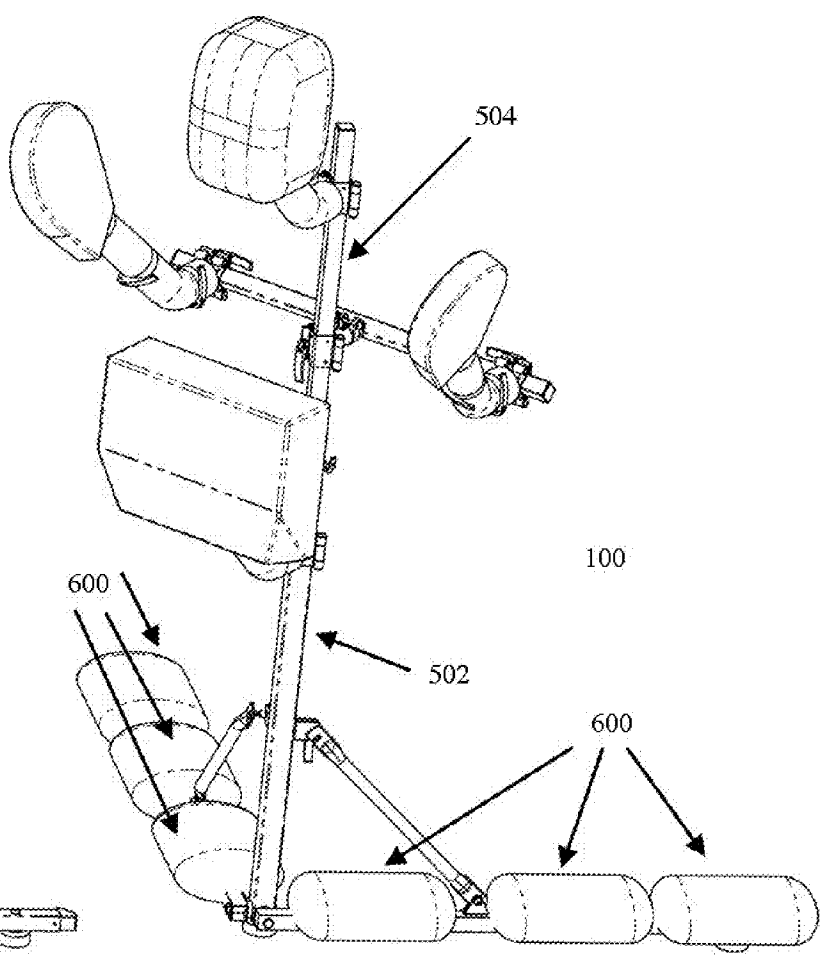
FIG. 6 illustrates a perspective view of the training stand of FIG. 1 with weight bags thereon.
Figure 18:
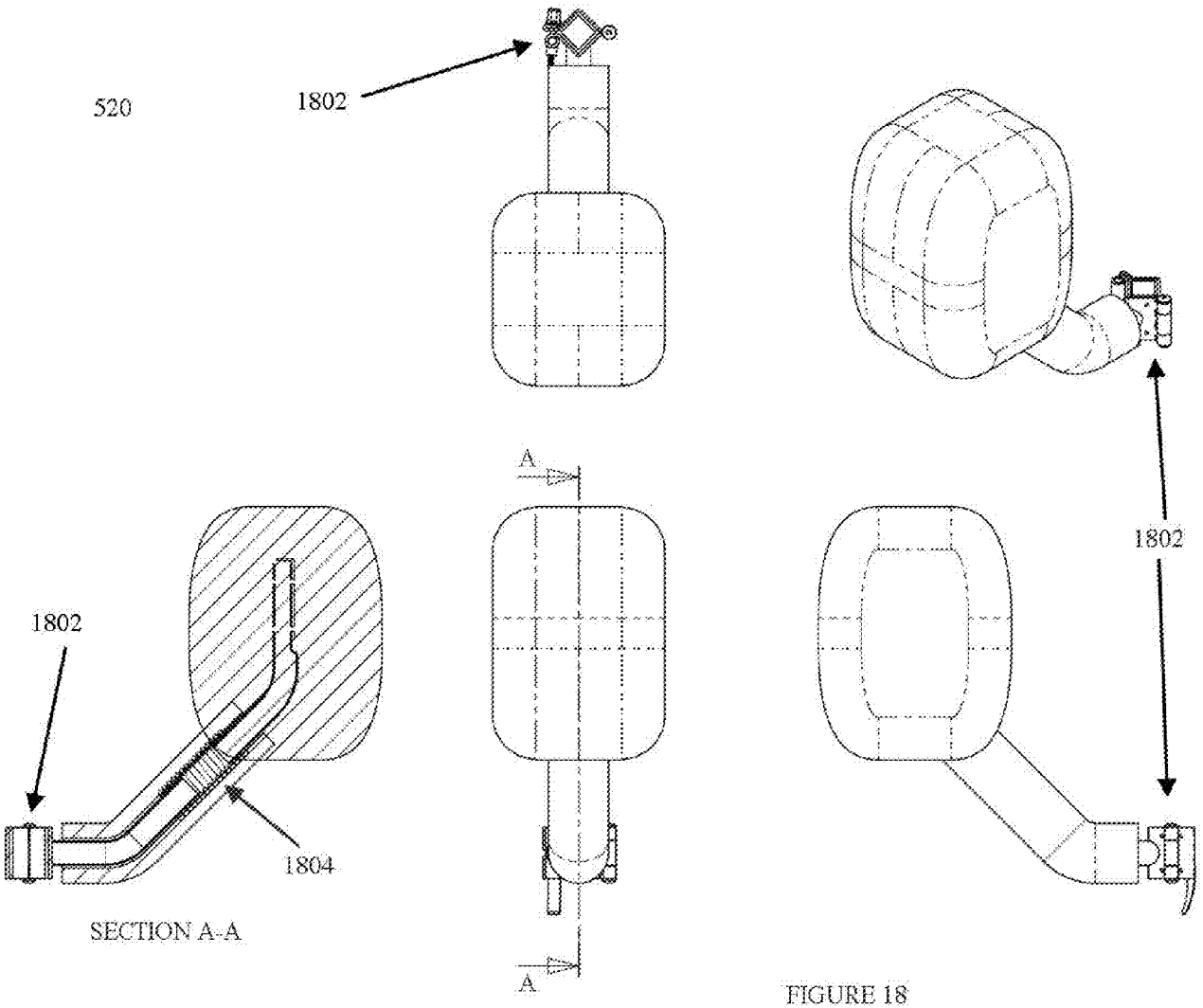
FIG. 18 illustrates various views of an embodiment of a head target which may be positioned on the training stand of FIG. 1 or FIG. 9.
Figure 19:
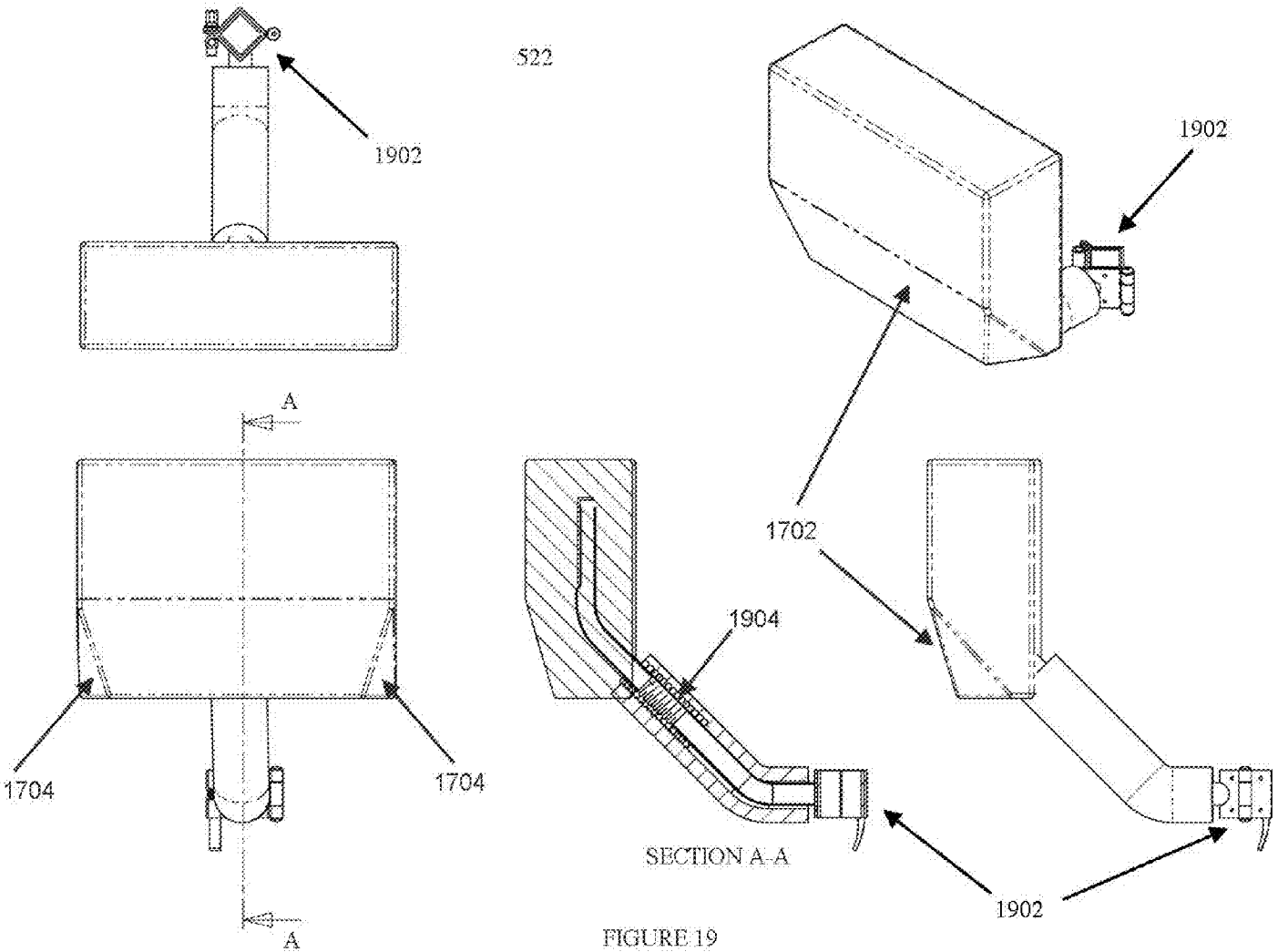
FIG. 19 illustrates various views of an embodiment of a torso target which may be positioned on the training stand of FIG. 1 or FIG. 9.
Figure 20:
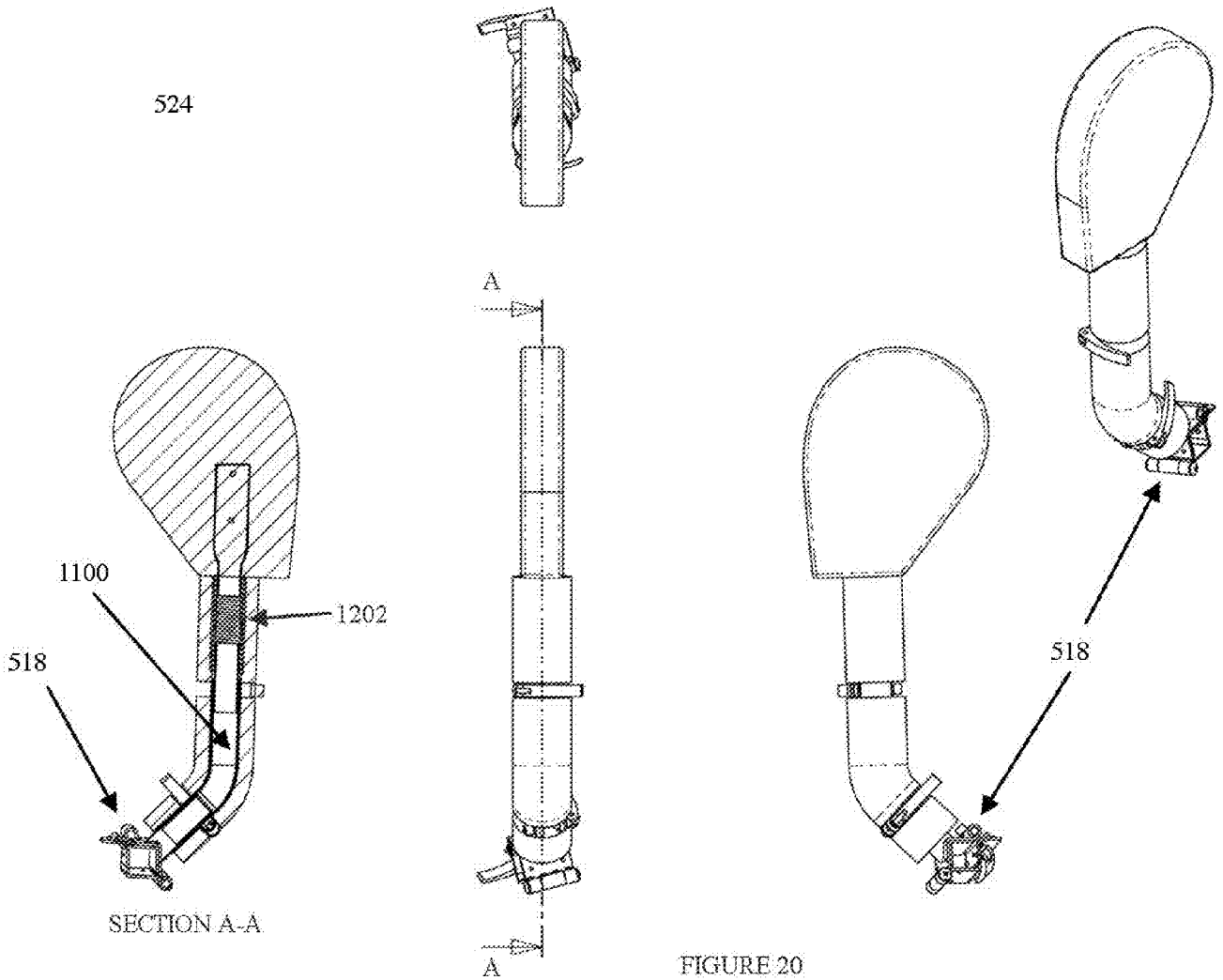
FIG. 20 illustrates various views of an embodiment of a hand target may be positioned on the training stand of FIG. 1 or FIG. 9.

The connector 518 may be removable from the pad as shown in the configuration in FIGS. 15, 16 and 20. Alternatively, the connector 518 may be permanently attached to one of the pads as shown in FIG. 18 item 1802 and in FIG. 19 item 1902. One advantage of attaching some pads permanently to a connector is to hold the pads securely in a preferred orientation. For example, head and torso pads may be held in the vertical orientation so they are permanently attached to the connectors. In some embodiments, the connectors allow for rotational movement about the training stand FIG. 5 and 6 illustrate how different objects, i.e., striking pads or targets may be coupled to the training stand 100. A first target 520 may be in the form of a human head while a second target 522 may be in the form of a human torso. The shapes of first and second targets 520, 522 are shaped to allow upper cut punching thereto. Moreover, second target 522 may include angled corners, 1702 and 1704 i.e., at the bottom corners, to guide the user to use correct form. The optional T-Bar support 528 is shown attached to the telescoping piece 504 in a substantially horizontal orientation. Additional targets 524 and 526 mimic an attacker's arm and hand and are shown attached to the T-Bar support 528. Each pad or target 520 and 522 may be adjusted up or down along the length of the central support shaft 502 and telescoping piece 504. Each pad or target may be coupled to the central support shaft 502 and telescoping piece 504 using connectors 518, 1802 or 1902. Each pad or target 524 and 526 may be adjusted anywhere along the length of the T-Bar support 528 using connectors 518. Although the T-Bar support 528 is shown in a substantially horizontal orientation, the T-Bar support 528 may be adjusted in any vertical position or a 360 degrees orientation relative to the tube 1506 in the connector 518. This helps accommodate users of different heights as well as to simulate a person of different heights for whom the user wishes to defend himself or herself against.

Figure 1:
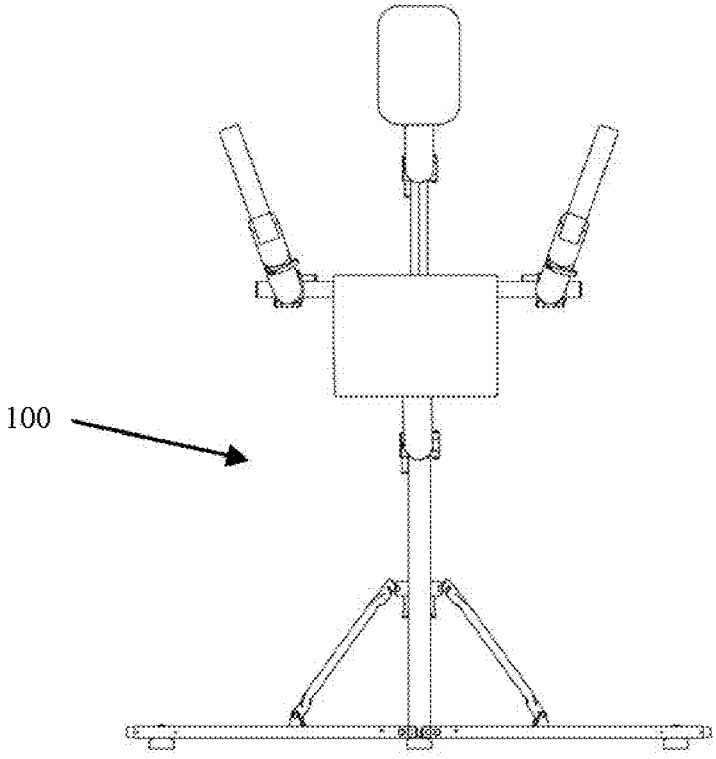
FIG. 1 illustrates a front view of a training stand according to an embodiment of the invention.
Figure 2:
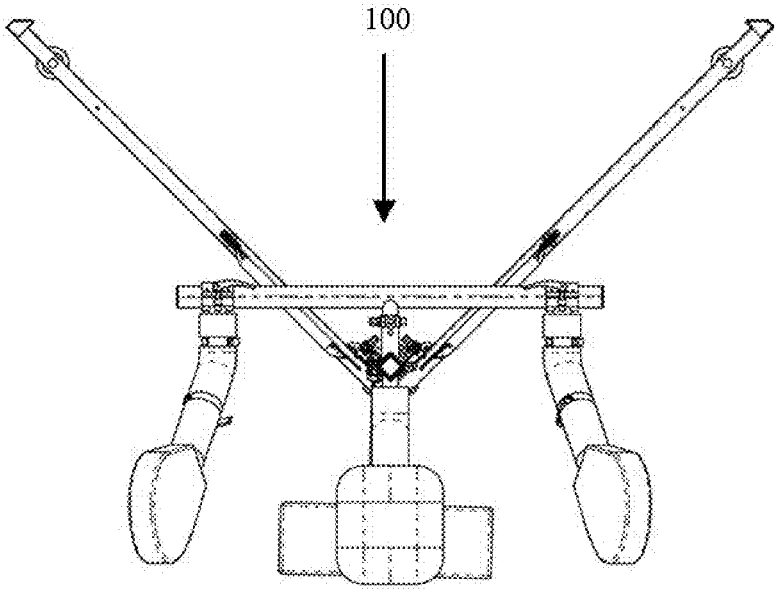
FIG. 2 illustrates a top view of the training stand of FIG. 1.
Figure 4:
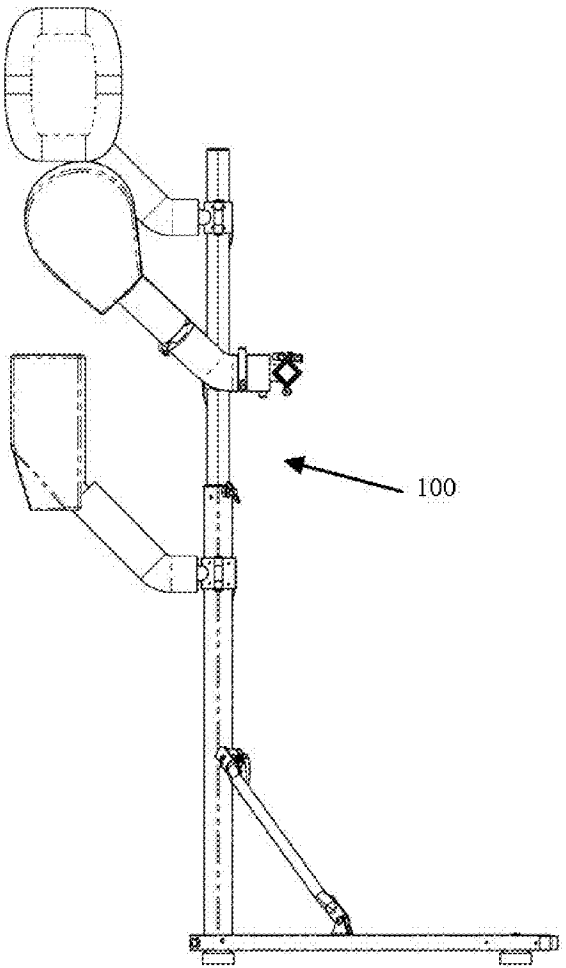
FIG. 4 illustrates a left side view of the training stand of FIG. 1.
Figure 3:
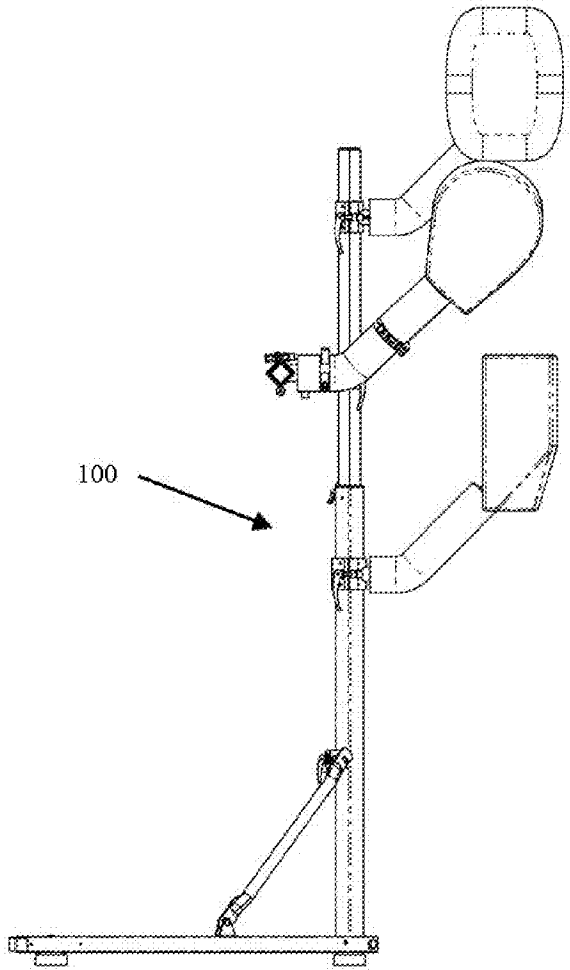
FIG. 3 illustrates a right side view of the training stand of FIG. 1.
Figure 21:
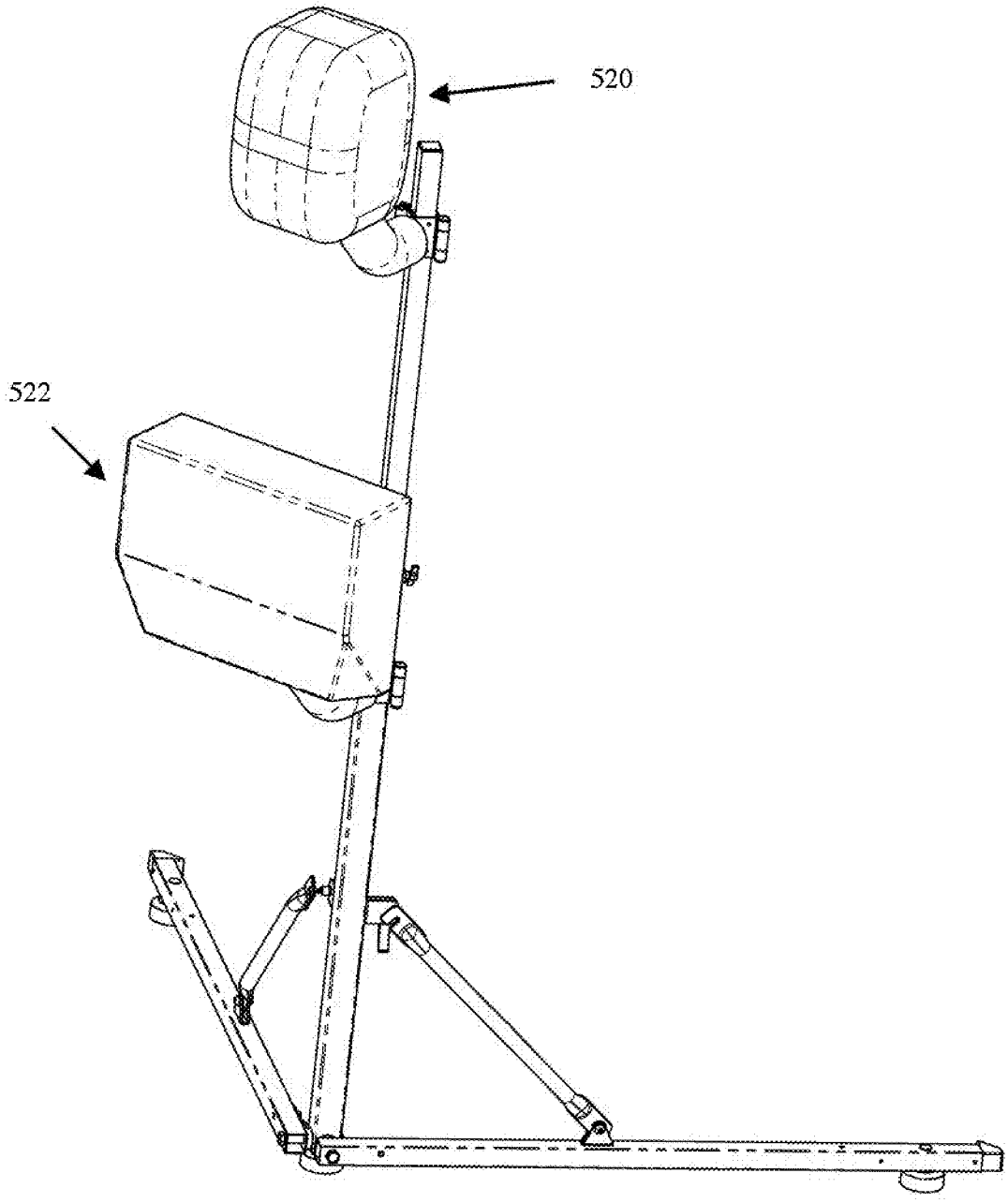
FIG. 21 illustrates a perspective view of another configuration the training stand of FIG. 1.

FIG. 21 illustrates a perspective view of another configuration the training stand of FIGS. 1 and 5. In this configuration the training stand includes just the first target 520 (head pad) and second target 522 (torso pad) while the remaining targets have been removed.

Figure 22:
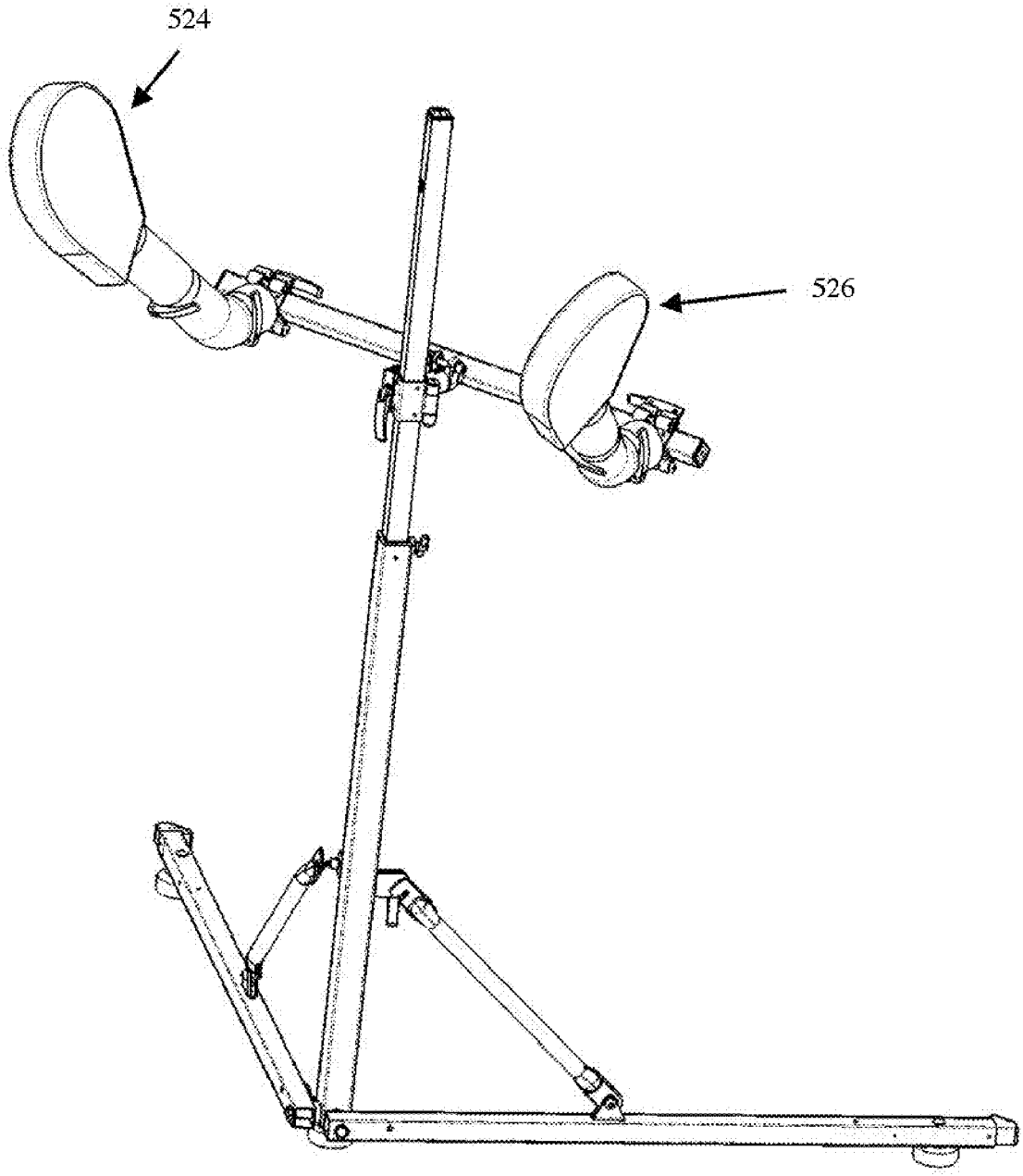
FIG. 22 illustrates a perspective view of yet another configuration the training stand of FIG. 1.

FIG. 22 illustrates a perspective view of yet another configuration the training stand of FIGS. 1 and 5. In this configuration the training stand includes just the pads 524 and 526 attached to the T-bar support while the remaining targets have been removed.

Figure 17:
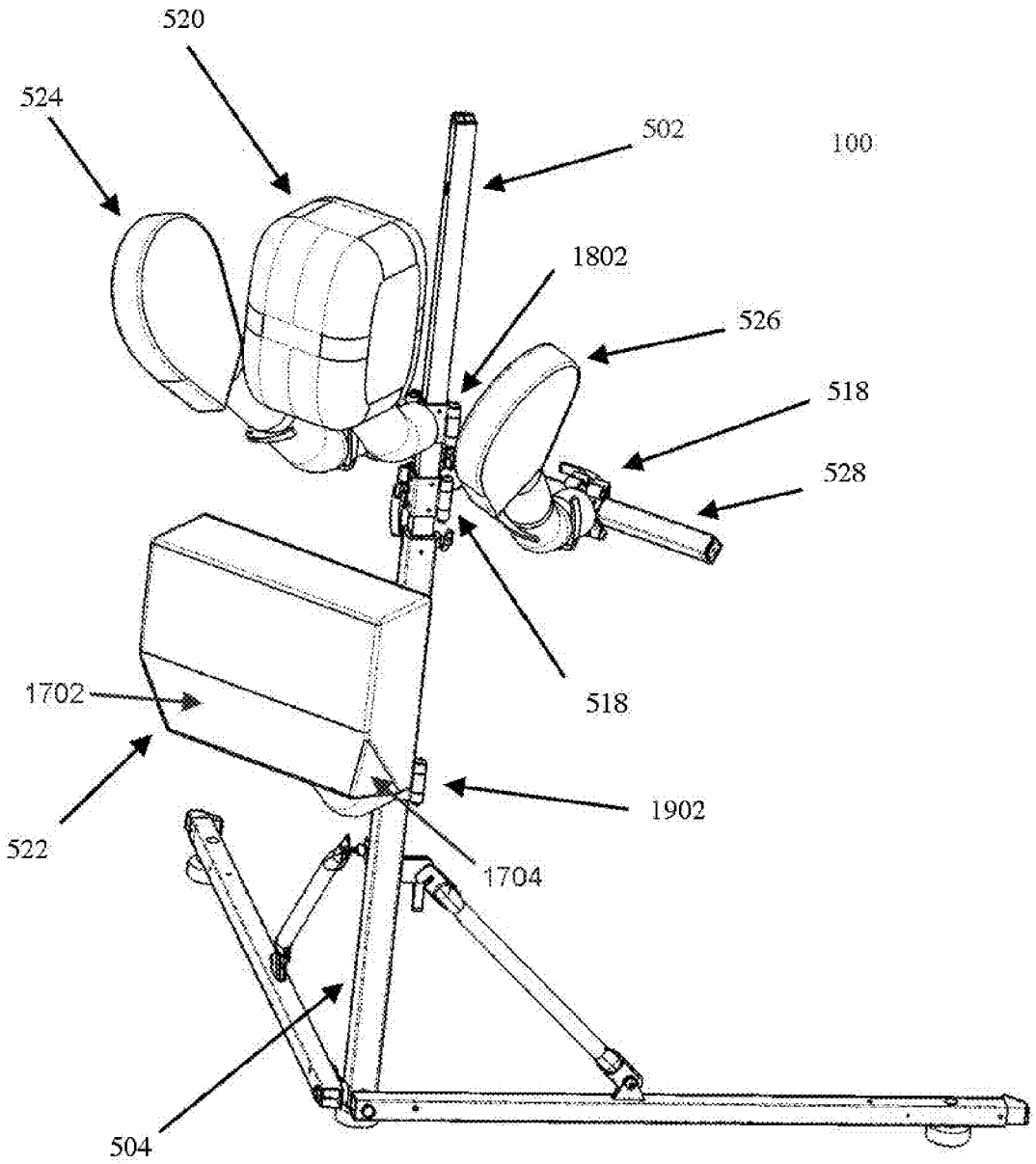
FIG. 17 illustrates a perspective view of the training stand of FIG. 1.

FIG. 17 illustrates how the same training pads and targets shown in FIG. 5 can be adjusted to simulate a smaller sized opponent. The human head shape target 520 and the human torso shape target 522 have been moved downward significantly along the central support shaft 502 and telescoping piece 504. The arm shaped targets 524 and 526 have moved significantly inward toward the central support shaft 502.

FIGS. 9, 10, 11, 12 and 13 illustrate the targets 524 and 526 in different positions attached to the training stand 100. The targets may be rotated into different orientations by adjusting the connectors 518 for practicing punching or kicking from any direction up, down, side to side or any angle in between. Between the connectors 518 and strike pads, the targets 520, 522, 524 and 526 may include a spring 1202, 1804 and 1904 such as a coil spring, or some other flexible material and/or component that can absorb or break the impact when the pads are struck.

Figure 11:
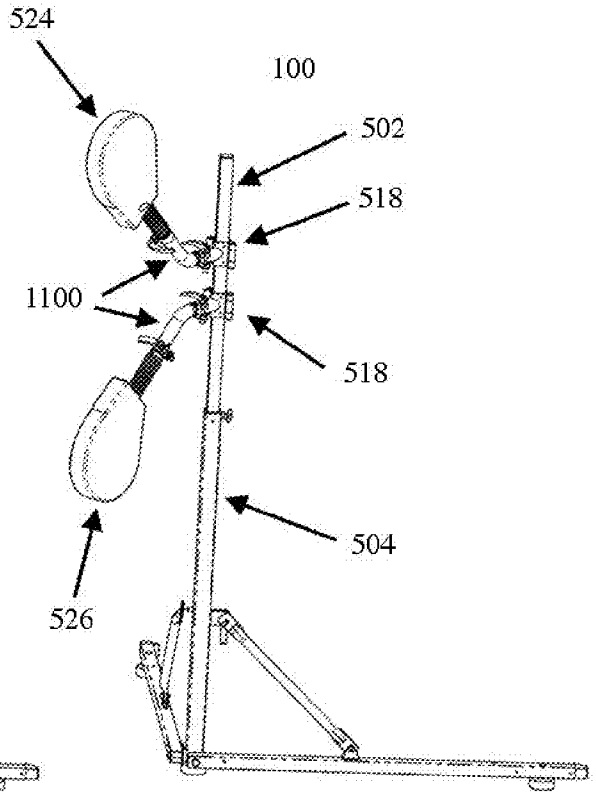
FIG. 11 illustrates the training stand of FIG. 9 with at least two targets positioned in yet another alternative position thereon.
Figure 10:
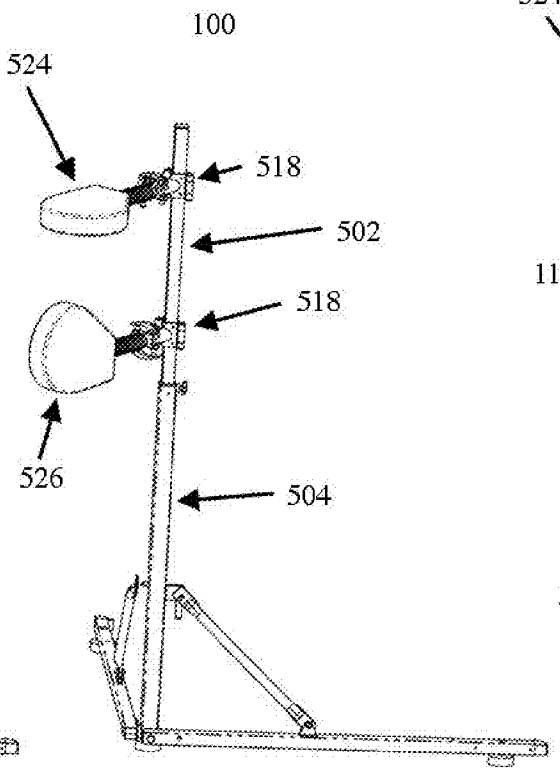
FIG. 10 illustrates the training stand of FIG. 9 with at least two targets positioned in an alternative position thereon.
Figure 9:
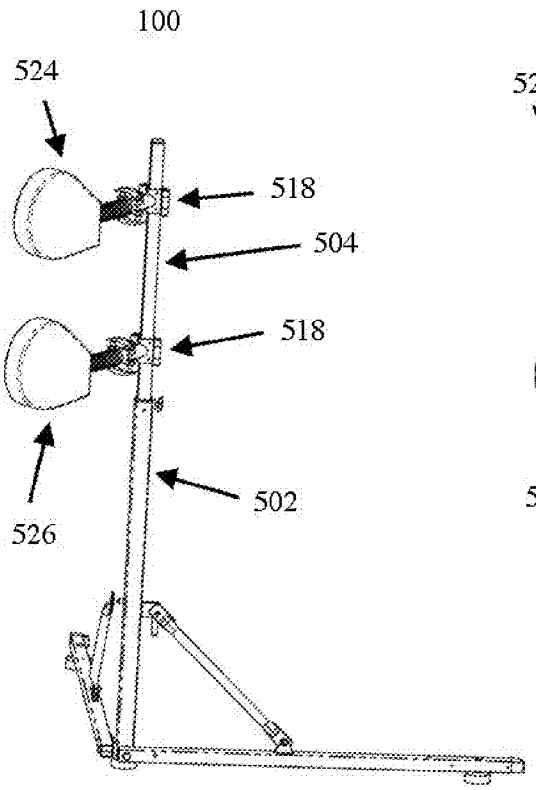
FIG. 9 illustrates a training standing according to another embodiment of the invention with at least two targets positioned thereon.
Figure 13:
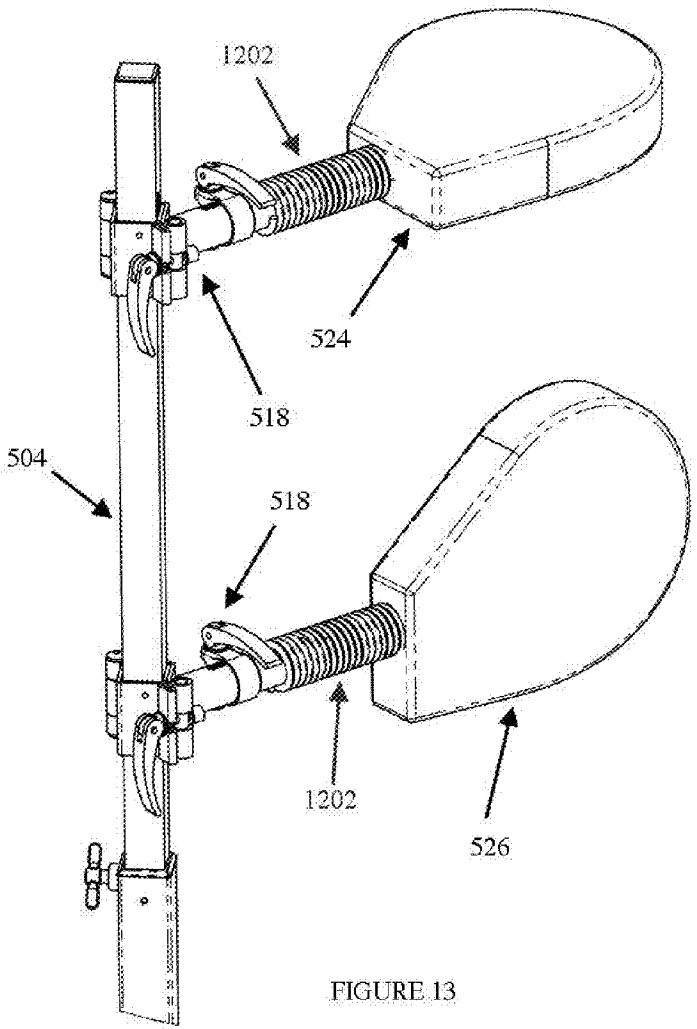
FIG. 13 illustrates a close-up view of at least two targets alternatively positioned on the training stand of FIG. 9.
Figure 12:
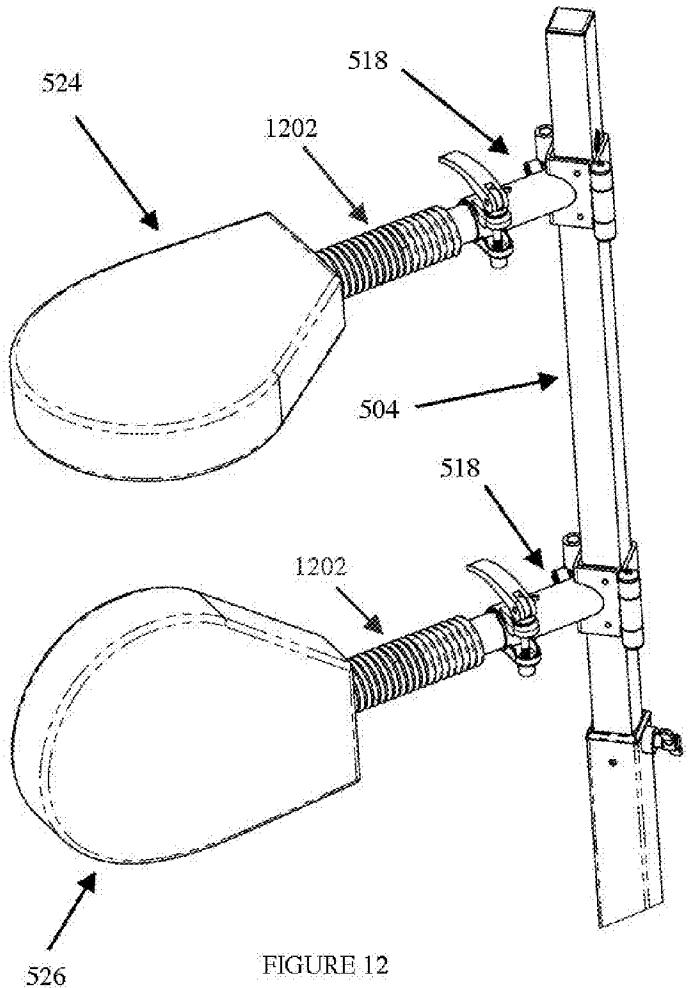
FIG. 12 illustrates a close-up view at least two targets positioned on the training stand of FIG. 9.

FIG. 11 illustrates optional extension attachments 1100 with angles which allow the targets 524 and 526 to have an additional degree of freedom of adjustability in their orientation. In one embodiment, the extension attachment 1100 is angled at less than 90 degrees. In another embodiment, the extension attachment 1100 is angled at about 135 degrees, although other embodiments may allow the angle of the extension attachment 1100 to be adjustable to other angles. The extension attachment 1100 may include a spring, such as a coil spring or some other flexible material that can absorb or break the impact when the targets are struck.

In some embodiments, there may be additional targets which attach to the training stand 100 using the same or different types of connectors. In other embodiments, there may be pads or targets in the shape of an arm, leg, hand or foot that attach to the training stand. Each of these may be adjusted along any position of the training stand.

In some embodiments, a fake gun or knife may be attached to the training stand 100, for example, to further practice self-defense techniques.

There may be additional type of targets that attach to the training stand that move on their own and actually simulate attacking the person who is training with the stand. This may be accomplished using electric motors or spring-loaded devices that release automatically or manually when the person training decides to release the moving attack targets. This movement may be regular or random.

FIG. 6 shows one implementation where weight bags (e.g., sand bags) 600 may be placed over the folding legs 506 and 508 to help keep the stand 100 in place when the pads or targets are struck. The use of small weight bags 600 allow for easily moving the training stand to a different location or putting it away for storage.

In alternative implementations, the training stand 100 may be kept in place by using weights that are normally used for weight lifting exercises.

In alternative implementations, the training stand can be permanently mounted to the ground using bolts or some other method, and the training stand still maintains the advantage of adjustability for users of many different sizes and training that simulates attackers of many different sizes.

In some implementations, parts of the support stand, e.g., central support shaft 502 and telescoping piece 504, may have additional padding to protect a user from accidentally hitting the stand 100.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A training device, comprising:

a collapsible stand having a central support shaft and a plurality of legs fixedly and pivotally coupled to a first end of the central support shaft, wherein in a first position, the legs and central support shaft collapse into each other and in a second position, the legs and central support shaft extend toward a rear side of the training stand and perpendicular relative to each other into a self-supporting stand having the central support shaft in a substantially vertical position, wherein the plurality of legs include no more than two legs that are reinforced by side linkages that are removably and pivotally coupled between a mid-section of each leg and the central support shaft;

a head-shaped strike pad and a torso strike pad adjustably and releasably coupled to the central support shaft at a front side of the training device, each strike pad having a connecting arm including a resilient spring, each striking pad releasably coupled by a quick release connector; and at least one angled extension attachment including the resilient spring and coupling at least one of the plurality of strike pads, wherein the resilient spring is positioned at an angle relative to the central support shaft and corresponding strike pad to enable the at least one angled extension attachment to provide a resiliently deformable engagement between the head-shaped or torso strike pad and the central support shaft.

2. The training device of claim 1 wherein the central support shaft comprises one or more telescoping shafts.

3. The training device of claim 1 wherein the at least one angled extension attachment is angled between 90 and 135 degrees relative to the central support shaft and couples at a rear and base of the head-shaped strike pad and torso strike pad to provide improved range of motion when struck.

4. A training device, comprising:

a collapsible stand having a central support shaft and a plurality of legs fixedly and pivotally coupled to a first end of the central support shaft, wherein in a first position, the legs and central support shaft collapse into each other and in a second position, the legs and central support shaft extend toward a rear side of the training stand and perpendicular relative to each other into a self-supporting stand having the central support shaft in a substantially vertical position;

a head-shaped strike pad and a torso strike pad adjustably and releasably coupled to the central support shaft at a front side of the training device, each strike pad having a connecting arm including a resilient spring, each striking pad releasably coupled by a quick release connector;

at least one angled extension attachment including the resilient spring and coupling at least one of the head-shaped or torso strike pads, wherein the resilient spring is positioned at an angle relative to the central support shaft and corresponding strike pad to enable said at least one angled extension attachment to provide a resiliently deformable engagement between the head-shaped or torso strike pad and the central support shaft; and a T-bar support releasably coupled to a middle section of the central support shaft and extending toward the rear side and to the left and right sides of the training device, wherein the T-bar support is adapted to slidably and releasably couple additional strike pads along its length, where the strike pads are located at the front side of the training device, at least one of the additional striking pads is coupled to the T-bar support by the angled extension attachment and is adjustably positioned along the length of the T-bar support to approximate a hand of a person in a defensive or offensive position.

5. The training device of claim 1 wherein the quick release connector allows for rotation of the striking pad about the training device.

6. A training stand, comprising:

a central support shaft, wherein the central support shaft comprises one or more telescoping shafts;

a head-shaped strike pad and a torso strike pad positioned toward a front side of the training stand;

means for angling at least one of the strike pads to the training stand at approximately 135 degrees relative to the central support shaft;

means for providing resilience to the means for angling at least one of the strike pads;

at least two legs fixedly and pivotally connected to a first end of the central support shaft, the at least two legs adapted to collapse into the central support shaft in a first position and adapted to extend perpendicular to the central support shaft in a second position, in the second position the at least two legs are located at a rear side of the training stand so as to stabilize the central support shaft when the head-shaped or torso strike pad is struck toward the rear side;

means for fixedly and pivotally coupling the at least two legs to a first end of the central support shaft; and means for adjustably and releasably coupling the head-shaped strike pad and torso strike pad to the central support shaft.

7. The training device of claim 6, further comprising, a T-bar support releasably coupled to a middle section of the central support shaft and extending toward the rear side and to the left and right sides of the training device, wherein the T-bar support is adapted to slidably and releasably couple additional striking pads along its length, where the strike pads are located at the front side of the training device.

8. The training device of claim 7 wherein at least one of the striking pads is coupled to the T-bar support by the means for angling and is positioned to approximate a hand of a person in a defensive or offensive position, wherein the means for angling includes a resilient spring positioned at an angle relative to the T-bar support.

9. The training device of claim 4 wherein the additional strike pads are hand target strike pads, and at least one angled extension attachment includes a first coupler at a first end for removably coupling to the central support shaft and a second coupler at a second end for removably and rotatably coupling to a hand target strike pad, wherein the second coupler allows the corresponding hand target strike pad attached thereto to be rotated independent of the angled extension attachment.

10. The training device of claim 4, wherein each of the additional strike pads is interchangeably attachable to either the central support shaft or the T-bar support.

11. The training device of claim 1, wherein the torso strike pad is defined by a substantially rectangular shape having an angled lower edge and angled lower corners.

12. The training device of claim 4, wherein the training device and head-shaped strike pad, torso strike pad, and additional strike pads are located in a front portion of the training device and arranged to resemble a human such that all strike pads can be struck without interference from other strike pads and without rearranging the strike pads.

* * * * *